US006226605B1

(12) United States Patent
Nejime et al.

(10) Patent No.: US 6,226,605 B1
(45) Date of Patent: May 1, 2001

(54) DIGITAL VOICE PROCESSING APPARATUS PROVIDING FREQUENCY CHARACTERISTIC PROCESSING AND/OR TIME SCALE EXPANSION

(75) Inventors: Yoshito Nejime; Hiroshi Ikeda, both of Hachioji; Masao Hotta, Hanno, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/132,214

(22) Filed: Aug. 11, 1998

Related U.S. Application Data

(63) Continuation of application No. 08/462,268, filed on Jun. 5, 1995, now Pat. No. 5,794,201, which is a continuation of application No. 07/931,375, filed on Aug. 18, 1992, now abandoned.

(30) Foreign Application Priority Data

Aug. 23, 1991 (JP) ..... 03-211872
Mar. 3, 1992 (JP) ..... 04-045257

(51) Int. Cl.[7] ..... G10L 11/04
(52) U.S. Cl. ..... 704/207; 704/210; 704/271
(58) Field of Search ..... 704/205, 207, 704/500, 200, 210, 215, 214, 208, 270, 271, 501, 503

(56) References Cited

U.S. PATENT DOCUMENTS

Re. 36,478 * 12/1999 McAulay et al. ..... 704/206
3,681,756 8/1972 Burkhard et al. .

(List continued on next page.)

FOREIGN PATENT DOCUMENTS 4227826 12/1995 (DE) .
59-123400 7/1984 (JP) ..... H04R/25/00

(List continued on next page.)

OTHER PUBLICATIONS

Nonomura, "The Topics of Hearing Aid", Journal of the Acoustical Society of Japan, vol. 45, No. 7, pp. 549–555, 1989.
Ohyama, "Digital Hearing Aid Emphasizing Speech Characteristics", Journal of the Acoustical Society of Japan, vol. 43, No. 5, pp. 356–361, 1987.

* cited by examiner

*Primary Examiner*—Richemond Dorvil
(74) *Attorney, Agent, or Firm*—Antonelli, Terry, Stout & Kraus, LLP

(57) ABSTRACT

Making use of a digital acoustic signal processing apparatus arranged by employing memory device for storing a digital acoustic signal, acoustic frequency feature enhancing device for enhancing an acoustic frequency feature, and low-speed sound reproducing device for changing a speed of the stored voice to reproduce this voice as a low speed into a hearing aid and an appliance with an acoustic output, a hearing function difficulty due to an age is aided in utilization of audio output appliances such as a hearing aid, television receiver, and a telephone receiver. After the voice has been stored in the memory device, a process for enhancing the frequency characteristic in order to fit the frequency characteristic to the individual hearing characteristic and the voice reproducing environment is carried out and thereafter represented to the user. The user can repeatedly listen the voice stored in the memory device with employment of control device for controlling the voice reproducing operation. Furthermore, since a process for expanding a time scale during a sound reproducing operation is carried out, the voice can be represented at the low speed. Since the voice whose frequency characteristic has been enhanced can be represented at the low speed in order that either an individual hearing ability, or an apparatus is fitted to a using environment, hearing articulation can be improved with respect to such a hearing, the frequency resolution and the time resolution are simultaneously deteriorated.

8 Claims, 6 Drawing Sheets

U.S. PATENT DOCUMENTS

| | | | | |
|---|---|---|---|---|
| 3,816,664 | | 6/1974 | Koch . | |
| 4,246,617 | * | 1/1981 | Portnoff | 360/32 |
| 4,425,481 | | 1/1984 | Mansgold et al. . | |
| 4,471,171 | | 9/1984 | Kopke et al. . | |
| 4,622,690 | | 11/1986 | Smith, III et al. . | |
| 4,624,012 | | 11/1986 | Lin et al. . | |
| 4,910,780 | | 3/1990 | Miki . | |
| 4,926,408 | | 5/1990 | Murakami et al. . | |
| 5,027,410 | | 6/1991 | Williamson et al. . | |
| 5,091,952 | | 2/1992 | Williamson et al. . | |
| 5,111,409 | | 5/1992 | Gasper et al. . | |
| 5,119,474 | | 6/1992 | Beitel et al. . | |
| 5,175,769 | * | 12/1992 | Hejna, Jr. et al. | 704/211 |
| 5,206,929 | | 4/1993 | Langford et al. . | |
| 5,237,547 | | 8/1993 | Ohkuma et al. . | |
| 5,237,648 | | 8/1993 | Mills et al. . | |
| 5,239,532 | | 8/1993 | Hensing et al. . | |
| 5,263,008 | | 11/1993 | Fujito et al. . | |
| 5,274,758 | | 12/1993 | Beitel et al. . | |
| 5,291,462 | | 3/1994 | Richards . | |
| 5,333,124 | | 7/1994 | Kikuchi et al. . | |
| 5,341,432 | | 8/1994 | Suzuki et al. . | |
| 5,388,197 | | 2/1995 | Rayner . | |
| 5,430,835 | | 7/1995 | Williams et al. . | |
| 5,513,306 | | 4/1996 | Mills et al. . | |
| 5,617,507 | * | 4/1997 | Lee et al. | 704/200 |
| 5,630,013 | * | 5/1997 | Suzuki et al. | 704/216 |

FOREIGN PATENT DOCUMENTS

| | | | |
|---|---|---|---|
| 60-143100 | 7/1985 | (JP) | H04R/25/04 |
| 1179599 | 7/1989 | (JP) . | |

DIGITAL VOICE PROCESSING APPARATUS PROVIDING FREQUENCY CHARACTERISTIC PROCESSING AND/OR TIME SCALE EXPANSION

REFERENCE TO EARLIER FILED APPLICATIONS

This application is a continuation of the following earlier filed application(s): Ser. No. 08/462,268, filed Jun. 5, 1995, issued as U.S. Pat. No. 5,794,201; which is a continuation of Ser. No. 07/931,375, filed Aug. 18, 1992, abandoned.

BACKGROUND OF THE INVENTION

The present invention generally relates to an apparatus for aiding a hearing function difficulty due to an aging effect and the like. More specifically, the present invention relates to a digital acoustic signal processing apparatus for improving voice articulation.

Conventionally, it has mainly used an analog type hearing aid to process an amplitude and a frequency characteristic of a voice with employment of an analog circuit to aid difficulty in hearing. On the other hand, very recently, in the held of the hearing aids for aiding declined hearing ability, it has been developed digital hearing aids with application of digital signal processing to aid difficulty in hearing. With respect to this research and development trends, one of examples is disclosed in "The Topics of Hearing Aid" of A Journal of the Acoustical Society of Japan, volume 45, No. 7, 1989, pages 549 to 555. The acoustic signal processing method employed in the digital hearing aid is described in "Digital Hearing Aid Emphasizing Speech Characteristics" of A Journal of the Acoustical Society of Japan, volume 43, No. 5, 1987, pages 356 to 361. The method for aiding hearing ability by way of a hearing aid into which an audio output from a television receiver or the like is inputted, has been described in JP-A-1-179599.

SUMMARY OF THE INVENTION

The acoustic signal process in the digital hearing aid is performed by the digital signal process with employment of the digital signal processor (will be referred to a "DSP"), and a content of this digital signal process is described by the program. As a consequence, in the digital hearing aid, the contents of the acoustic signal process can be varied by changing the program stored in the memory, as compared with the conventional analog hearing aid, so that the fitting operation to optimize voice articulation with regard to an individual patient can be easily performed. As the acoustic signal process operation used in this digital hearing aid, there are process operations for aiding difficulty in hearing in frequency resolution, time resolution, spectral feature extraction ability, and sound image reconstruction ability and the like. For instance, there are a frequency feature enhancement with employment of a digital filter, and also a silent period inserted between a consonant and a vowel. Although such a digital acoustic signal processing technique used to aid hearing ability has been developed with an aim to be reflected in a hearing aid, it is also possible to provide an appliance, or device easy to be handled by hearing difficulty people by utilizing a similar technique into "a device with sound output" such as a television receiver and a telephone.

In an acoustic signal processing apparatus used in a hearing aid, a real time process is required. That is to say, all of signal process operations must be completed within such a shorter time delay which cannot be felt by a user. Since such a real time process is necessarily required even in the conventional analog type hearing aids and also in the conventional digital type hearing aids, no consideration is made in that after the acoustic signal process to improve the voice articulation has been performed, the processed voice is outputted at the low speed.

When the hearing aid aims to sensorneural hearing difficulty people who may be aged persons, to improve voice articulation by enhancing the voice, a sufficient effect cannot be expected by merely enhancing the frequency characteristics of the voice, but the time characteristic of the voice must be emphasized at the same time when the frequency characteristic thereof is enhanced, in order that a "slow and clear" voice is produced. Also, there are many possibilities that hearing difficulty people may understand a content of a speech made by a speaker by repeatedly hearing this story from the speaker. The hearing difficulty people feel difficulties in any cases other than a man-to-man conversation, because they cannot repeatedly listen to the speech. No care is taken in such a solution to aid the repeated hearing action in the acoustic signal processing apparatus employed in the conventional digital hearing aids.

Moreover, substantially no consideration is made of the solution to slowly output a voice because of its real time characteristic in the conventional appliances, for example, a television receiver and a telephone set. Accordingly, a part of hearing difficulty persons feels difficulties when the "appliance with sound output" such as the television receiver and telephone set is used. In accordance with the conventional method for aiding hearing ability by way of the hearing aids into which the audio output from the television receiver or the like is inputted, there is no idea to utilize the acoustic signal process employed in the hearing aid within the "appliance with sound output" such as a television receiver and the telephone set.

An object of the present invention is to provide a digital acoustic signal processing apparatus used in a digital hearing aid and an "appliance with sound output" such as a television receiver and a telephone set in order to aid hearing ability difficulty due to an aging phenomenon.

This object may be achieved by providing a digital acoustic signal processing apparatus within a hearing aid and an appliance with sound output. The digital acoustic signal processing apparatus is constructed with an acoustic signal memory section for storing a digital acoustic signal, an acoustic frequency characteristic enhancing section for enhancing a frequency characteristic of a voice, and also low speed sound reproducing device for changing a speed of the stored voice to reproduce this voice at low speed.

In a digital hearing aid employing the digital acoustic signal processing apparatus according to the present invention, since after the voice has been stored in the acoustic signal memory section, a process for expanding a time scale of an acoustic signal is performed, the voice obtained after the enhancement process is represented to a user at low speed. Also, since the user can repeatedly reproduce a voice stored in the acoustic signal memory section with employment of a control section for controlling the voice reproducing operation, the user can repeatedly listen to the voice represented just before even when he cannot directly ask a speaker for again to repeat the previous talk.

In accordance with the present invention, since the voice whose frequency characteristic has been emphanced in order to be fitted to the individual characteristic is represented at low speed, the hearing characteristic of the hearing difficulty person with the deteriorated time resolution can be compensated. Also, since there is a function to store the voice, the inputted voice can be repeatedly reproduced afterward. As a consequence, even when the hearing difficulty person cannot repeatedly hear the speech made by the speaker, he can understand the information given by the voice. In addition, when the time scale expansion processing operation is carried out in the voice reproduction mode, since there is spare time produced by reproducing the voice at low speed, such a complex process that could not realized in view of the process speed of the DSP (digital signal processing) in the real time process, may be utilized.

The acoustic frequency characteristic processing section employed in the digital acoustic signal processing apparatus of the present invention, processes the frequency characteristic of the acoustic signal supplied from the device with sound output such as a television receiver and a telephone set in order to be fitted to the frequency characteristic of the hearing ability of the user and the user environment thereof. The voice to be represented is stored in the acoustic signal memory section, and thereafter the stored voice is reproduced by an apparatus for reproducing the voice with changing the speed of this voice. Furthermore, in case of the television receiver, since the voice must be outputted in synchronism with the picture, when the speed of the voice is changed during the voice reproduction, the same delay time is given to the picture signal.

In accordance with the present invention, since the voice whose frequency characteristic has been emphanced can be represented at low speed in order to be fitted to the individual hearing ability, or the environment where the apparatus is used, the hearing articulation can be improved with respect to the hearing ability whose frequency resolution and time resolution are simultaneously deteriorated.

DESCRIPTION OF THE PREFERRED EMBODIMENTS

Referring now to drawings, preferred embodiments of the present invention will be described in detail.

Figure 1:
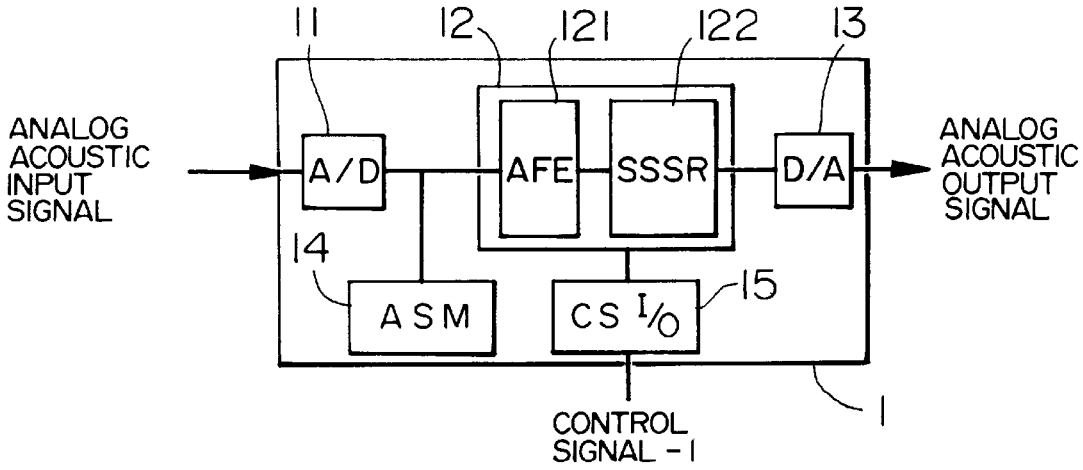
FIG. 1 is a schematic block diagram for representing an arrangement of a digital acoustic signal processing apparatus according to an embodiment of the present invention.

FIG. 1 is a schematic block diagram for representing an arrangement of a digital acoustic signal processing apparatus according to an embodiment of the present invention. The digital acoustic signal processing apparatus, according to a preferred embodiment of the present invention, is arranged by an A/D (analog-to-digital) converting section 11 for A/D-converting an analog acoustic signal, an acoustic signal memory 14 for storing an A/D converted digital acoustic signal, a signal processing section 12 (will be simply referred to a "DSP") for processing the digital acoustic signal, a D/A converting section 13 for D/A-converting the digital signal processed in the signal processing section 12 into an analog signal; and a control signal I/O (input/output) section 15 for inputting/outputting a control signal-1 given by a user. In the signal processing section 12, both of an acoustic feature enhancing section 121 for enhancing an acoustic frequency characteristic, and a slow speed sound reproducing section 122 for reproducing the acoustic signal at low speed that is different from speed during the signal input are prepared in a program form.

In general, an acoustic signal transmitted via either a broadcasting signal, or a telephone line and the like, is converted into an audible band signal, by either a receiver or a signal receiving circuit, and then the audible band signal is supplied via a speaker or the like to a listener. In the digital acoustic signal processing apparatus according to the present invention, this electric acoustic signal converted into the audible band signal has been converted by the A/D converting section 11 into a digital signal, and thereafter is inputted into the DSP 12 and the acoustic signal memory 14.

In the DSP 12, the digital acoustic signal given from either the A/D converting section 11, or the acoustic signal memory section 14 is processed based on the control signal-1 supplied from the user by way of the acoustic feature enhancing section 121 employed therein. The user may freely set a selection of an acoustic signal process mode, a commencement and a completion of an acoustic signal process (will be discussed later). Various methods may be utilized in the acoustic feature enhancing section 121. As one example, there is such a multichannel compression method that a frequency band is subdivided by a digital filter, and signal amplifications are carried out for each of the subdivided frequency bands in response to levels fitted to personal audible characteristics.

Furthermore, the DSP 12 processes the digital audio signal by the low speed sound reproducing section 122 employed therein. In case that a voice is reproduced at low speed, there are provided as the low speed sound reproducing section 122, for instance, a method for expanding a silent period of the voice to expand a time scale (domain) at an output, and also a so-called "TDHS" method (i.e., a method for changing a time domain feature by cutting out a portion of a voice on the time domain, and by adding the cut signal and the adjoining acoustic signals with each other, while superimposing a window function with some slopes.

Generally speaking, if an impaired hearing phenomenon is mainly caused by people who ages, there are some possibilities that a time length for language processing in a brain is prolonged and also an acoustic signal processing ability for hearing is difficult. A major object of the time scale expansion processing is to give a spare time to compensate such a delayed process time. It is required to compensate a time shift between an input signal and an output signal when such a time scale expansion processing is performed. To this end, the acoustic signal memory section 14 is employed as a buffer for this requirement in the digital acoustic signal processing apparatus of the present invention. Either a data memory address of the acoustic signal memory section 14 is periodically used, or a capacity of the acoustic signal memory section 14 is selected to be sufficiently large. For instance, the capacity of this acoustic signal memory section 14 is selected to be such a sufficiently large value by which all of a single broadcasting program can be completely stored. The acoustic signal memory section 14 includes two independent reading/writing buses, the digital signal inputting operation from the A/D converting section 11 is performed independent from the data outputting operation to the DSP 12 within the acoustic signal memory section 14, and both of the acoustic signal storage and the acoustic signal reproduction are simultaneously performed via the same acoustic signal memory section 14. As a consequence, the A/D-converted output may be recorded in the acoustic signal memory section 14 and at the same time, the past recorded information may be read by the DSP 12.

As the acoustic signal memory section 14, a semiconductor memory, an optical disk apparatus, or a magnetic disk apparatus may be employed. These disk apparatuses usable in the present invention, comprise a head for writing information into the disk and separately a head for reading the information therefrom, so that both of the recording operation and the reproducing operation for the acoustic signal are simultaneously performed via the same disk.

On the other hand, very recently, the digital communication line and the digital broadcasting technique have been practically utilized, and an acoustic signal transmitted by this digital technology is not an analog signal, but a digital signal. When the digital acoustic signal processing apparatus according to the present invention is utilized under such a circumstance, since the input acoustic signal has been supplied in a digital acoustic signal form, the A/D converting section 11 of this digital signal processing apparatus is no longer required. It is also apparent that the D/A converting section 13 is not required in such an acoustic signal output section which can be directly driven by the digital signal and can output the digital signal.

Figure 2:
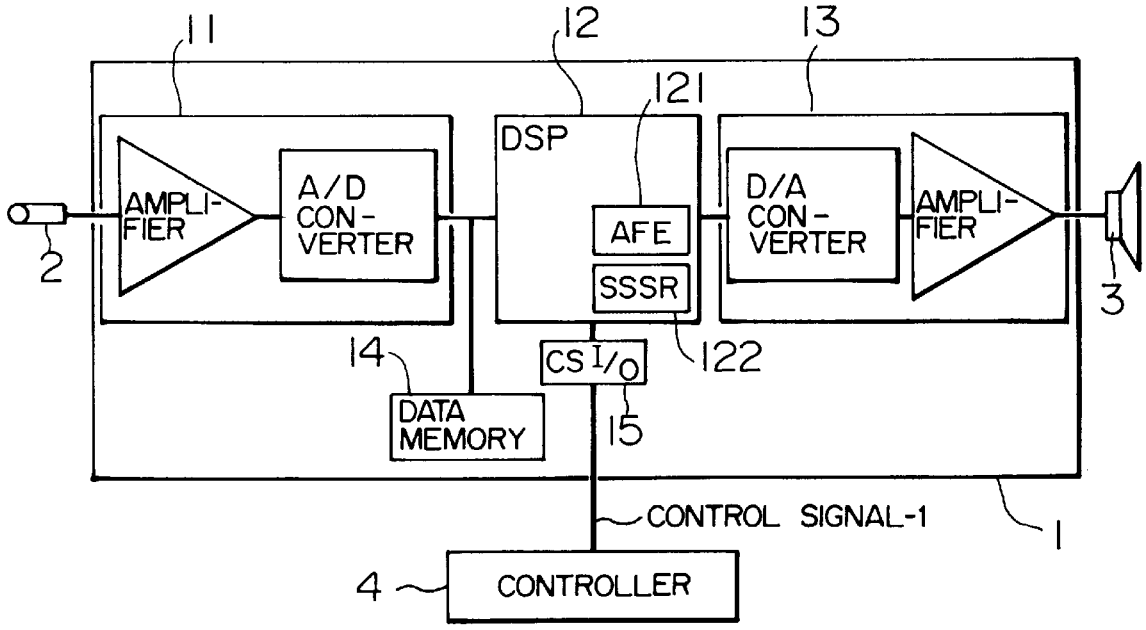
FIG. 2 is a schematic block diagram of a digital hearing aid using the digital acoustic signal processing apparatus of the present invention.

In FIG. 2, there is shown an arrangement of a digital hearing aid as a preferred embodiment, in which the digital acoustic signal processing apparatus according to the present invention is utilized. To the digital acoustic signal processing apparatus 1, a microphone 2 for inputting a voice and a receiver 3 for outputting the voice, and also a controller 4 for controlling the operation signal processing apparatus 1 are connected, so that the digital hearing aid may be constructed. A user can freely select the acoustic signal process mode, and also set the commencement and end of the acoustic signal process by way of the controller 4 (will be explained later), and a control signal-1 for the set condition is supplied by a controlling signal I/O section to the DSP 12. In the digital acoustic signal processing apparatus 1 according to this preferred embodiment, the A/D converting section 11 is constructed of an amplifier AMP for amplifying an output from the microphone 2 and an A/D converter. Similarly, the D/A converting section 13 is arranged by a D/A converter and an amplifier AMP for driving the earphone 3. Also, the acoustic signal memory section 14 is constructed of a semiconductor data memory for storing a digitalized acoustic signal, whereas a controlling signal I/O section 15 for controlling input/output of the control signal from the controller 4 (will be discussed below) is arranged by an I/O circuit. Furthermore, a signal processing section 12 for processing the digital signal corresponds to a digital signal processor (DSP) whose process content may be determined in accordance with a stored program. Within the program memory built in this DSP, a frequency feature enhancement program has been employed as the acoustic feature enhancing section 121, and also a program for expanding a time scale of a voice has been provided as the low speed sound reproducing section 122 for outputting the sound at the low speed different from the speed for the sound.

On the other hand, since there are large differences in hearing characteristics or features of hearing difficulty people, the above-described acoustic feature enhancement program is stored into the above-described program memory after the process parameters have been fitted to the personal hearing characteristics of the hearing difficulty people.

Figure 3:
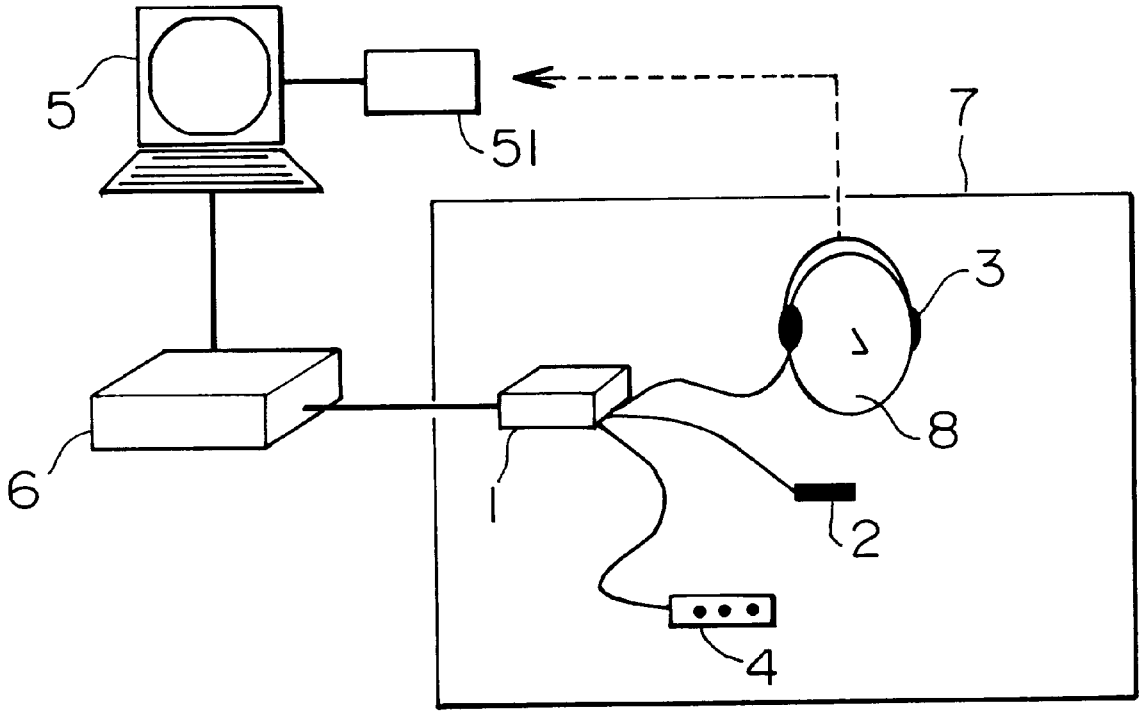
FIG. 3 schematically illustrates an arrangement of a system for fitting a characteristic of the digital hearing aid using the digital acoustic signal processing apparatus of the present invention.

In FIG. 3, there is shown an arrangement of a system for fitting acoustic characteristics of a digital acoustic signal processing apparatus of the present invention. The digital hearing aid 7 shown in detail in FIG. 2 is connected via a DSP emulator 6 to a personal computer 5. The function of the DSP built in the digital hearing aid 7 is simulated, or emulated by the DSP emulator 6 and the personal computer 5 with employment of a fitting characteristic program 51 of the personal computer 5. The parameter of this fitting characteristic program 51 is varied and a fitting operation is carried out in such a manner that the contents of the acoustic feature enhancement become optimum acoustic feature enhancement with regard to the user. The fitted parameters are stored in the program memory actually built in the digital hearing aid 7 for use.

Figure 4:
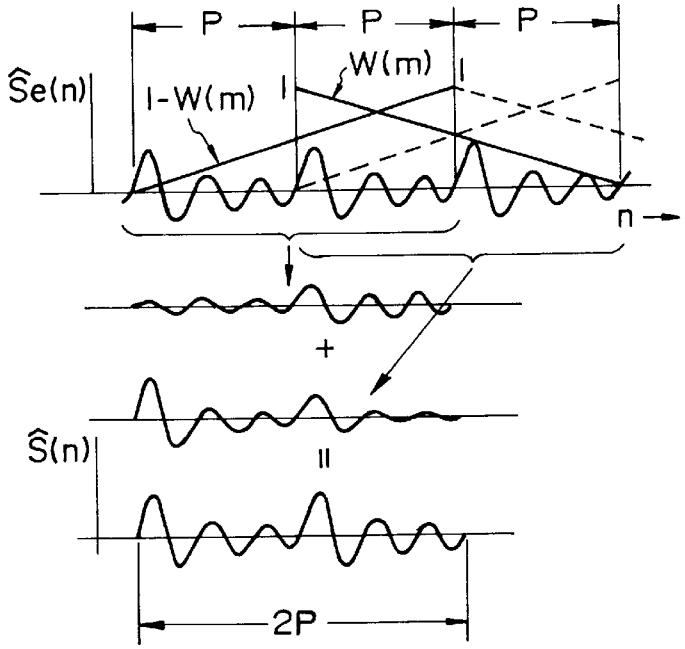
FIG. 4 shows a conceptional diagram of a first time-scale expanding algorithm employed in the digital hearing aid using the digital acoustic signal processing apparatus of the present invention.
Figure 5:
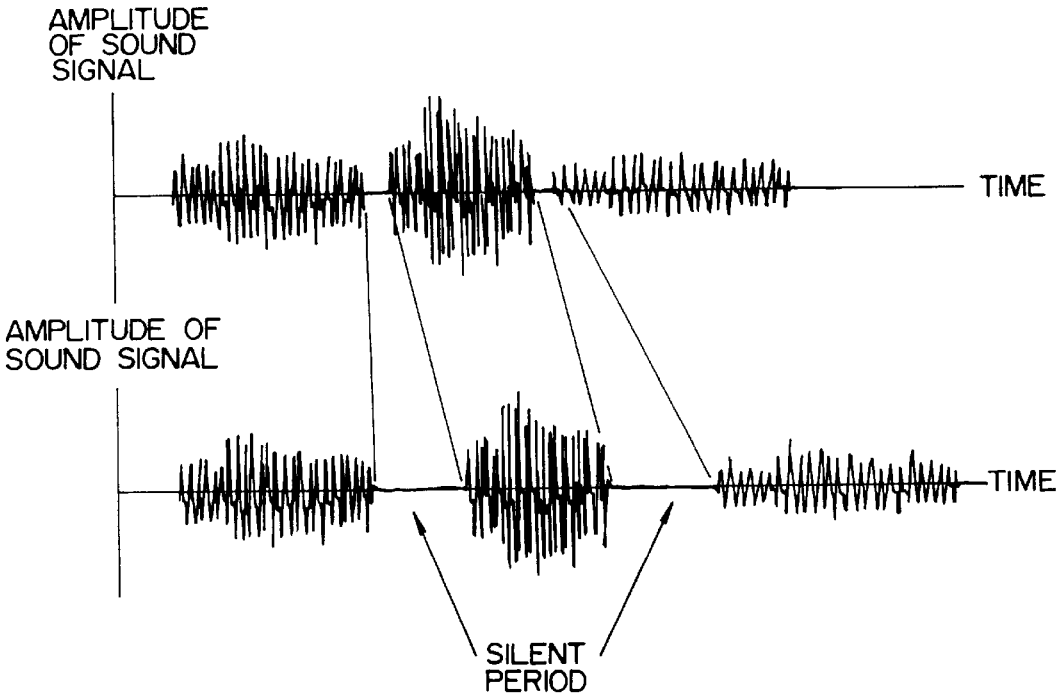
FIG. 5 indicates a conceptional diagram of a second time-scale expanding algorithm employed in the digital hearing aid using the digital acoustic signal processing apparatus.

FIG. 4 shows a conceptional diagram of a first time scale expansion processing algorithm employed in the digital hearing aid into which the digital acoustic signal processing apparatus of the present invention has been utilized. In general, this first algorithm is such a process so-called as "time domain harmonic scaling (TDHS)", that a sound signal is weighted by a triangle weight "W" within overlapped intervals each having a length of "P", the weighted sound signals are added to each other and then compressed to a length of "P", and the resultant sound signals are sampled at a period of a half original period. FIG. 5 shows a conceptional diagram of a second time scale expansion processing algorithm employed in the digital hearing aid into which the digital acoustic signal processing apparatus of the present invention has been utilized. This second algorithm is such a process to detect a silent period within an original acoustic, or sound signal and to expand only this silent period. This first and second acoustic signal processor are different from the low-speed reproduction employed in the tape recorder, and are such processes that a voice can be represented at low speed without lowering a pitch of an original voice. In accordance with the present invention, a digital process is carried out in which a harmonic of an input acoustic signal is expanded in a time domain in a pitch unit.

On the other hand, the digital hearing aid 7 of the present invention has two operation modes. A selection of the operation mode, a commencement of the operation and an end of the operation are given by a user. The first operation mode is a real time mode in which all of the processes are accomplished within a time delay which no user feels. In accordance with this operation mode, the frequency feature enhancement process such as a high frequency enhancement and a formant enhancement, and also the time domain enhancement process (for instance, a silent period of several milliseconds is interposed between a consonant and a vowel) by which a real time characteristic is not lost, are performed with respect to the output from the A/D converter. In this operation mode, also the output from the A/D converter is continuously stored into the data memory. It should be noted that when the data storage is continued exceeding the memory capacity of the data memory, only the latest data is always left in the data memory by periodically using the addresses of the data memory. For instance, the data memory is subdivided into two regions. The acoustic signal is stored into one subdivided region, and when the data storage capacity exceeds the allowable storage capacity of the data memory, the acoustic signal is stored into the other subdivided memory region by changing one memory region into the other memory region. Then, two memory regions are periodically utilized, so that only the latest acoustic signal data can be continuously left in the subdivided memory region.

The second operation mode corresponds to a sound reproducing mode for enhancement-processing the sounds stored in the data memory. In accordance with this second operation mode, the above-described time scale expansion process can be performed in addition to a real-time process. With employment of this second operation mode, any users can repeatedly hear the sounds. Furthermore, the voice may be reproduced at the lower speed than the actually represented speed during the storage operation by utilizing the time scale expansion processing. In addition thereto, the stored voice may be heard as a slow voice fitted to a hearing characteristic of a user.

Normally, a user uses the digital hearing aid according to the present invention in the real time mode. Then, if the user wants to repeatedly hear the voice produced just before, the sound reproduction mode is utilized. Based upon the control signal-1 supplied from the controller 4 shown in FIG. 2, two operation modes are changed, the reproducing operation in the sound reproducing mode is commenced or stopped, and the starting address for reproducing the sound data on the data memory is set. Depending upon the use conditions, these operations can be controlled by the user via the controller 4. With regards to the setting operation of the reproducing address, there is another possible method that, for instance, when a predetermined switch provided with the controller 4 is once depressed, the voice data recorded before several seconds are started to be reproduced, and also the sound data are retraced by the same time intervals and then reproduced every time this switch is depressed.

It should be noted that although in the above-described explanation, the acoustic feature enhancement process has been performed by utilizing the DSP, even when the circuit for performing a required digital signal process is realized with employment of such a digital circuit as a gate array or the like, the same function as in the first mentioned signal process can be obtained.

In the digital hearing aid using the digital acoustic signal processing apparatus according to the present invention, since the voice whose frequency characteristics have been fitted to the hearing features of the individuals may be provided at the low speed, the hearing characteristics of the hearing difficulty people whose time resolution is deteriorated can be compensated. Also, since the digital hearing aid has the function capable of storing the sound data, the inputted sound-data can be repeatedly reproduced after the sound data storage operation. As a consequence, a hearing difficulty user can readily understand information given by sounds in such a case that he cannot repeatedly hear the speech. Furthermore, when the time scale expansion processing is performed in the sound reproduction mode, since there is spare time made by the low-speed reproduction, the complex process which could not be realized due to the process speed of the DSP may be used in the real time process.

Figure 6:
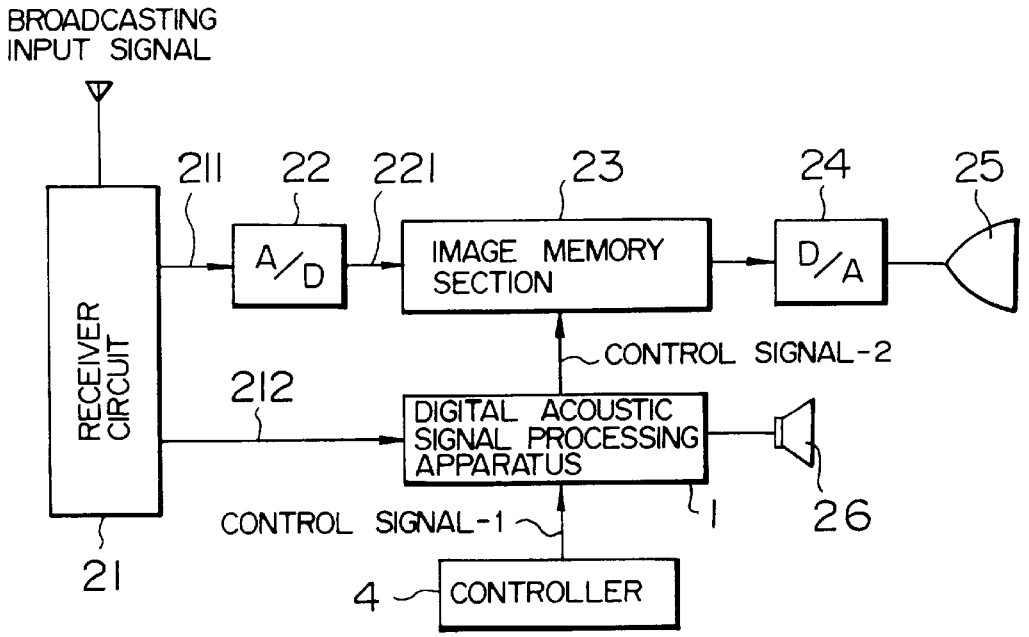
FIG. 6 is a schematic block diagram for showing an arrangement of a television receiver to which the digital acoustic signal processing apparatus of the present invention is used.

FIG. 6 is a schematic block diagram for showing an arrangement of a television receiver as a preferred embodiment, which utilizes the digital acoustic signal processing apparatus of the present invention. In this television receiver, both of an audio signal and a picture signal to be transmitted are analog signals. In case of a television receiver, the picture signal is simultaneously transmitted with the audio signal as the broadcasting signal, after the TV broadcasting signal is separated into an analog input picture signal 211 and an analog input audio signal 212 in a receiver circuit 21, the audio signal and the picture signal are separately processed in the digital acoustic signal processing apparatus 1 and then outputted to a speaker 26. The digital acoustic signal processing apparatus 1 of the present invention, receives the audio output which has been converted into the audible band by the receiver circuit 21 as the analog input audio signal 212 which will then be processed by the process operations as explained with reference to FIGS. 4 and 5. The selection of contents of acoustic process operation, the commencement of the acoustic process operation, and the completion of the acoustic process operation are supplied by a user from the controller 4, and a corresponding control signal-1 is given to the digital acoustic signal processing apparatus 1. More specifically, with respect to the frequency feature enhancement, the frequency characteristic is set, taking account of the acoustic characteristics of place environment surrounding this television receiver. On the other hand, the analog input picture signal 211 is converted into a corresponding digital picture signal by an A/D converter 22, which becomes a digital input picture signal (will be explained later), and is processed by an image memory section 23 (will be also described later). Subsequently, an output from the image memory section 23 is converted into a corresponding analog signal by a D/A converter 24 and then be displayed on a display 25.

In such a television receiver, since a sound must be outputted in synchronism with a picture, if the low speed sound reproducing process is executed for the input sound, the picture information process is carried out in such a manner that the same time delay as that of the sound signal is given to the picture signal based on a control signal-2 supplied from the digital acoustic signal processing apparatus 1. An image memory section 23 shown in FIG. 6 is used to perform this picture information process. Generally speaking, a frame length (interval) of a television picture is sufficiently longer than a length of digital audio data which has been sampled at a speed required for a voice band. For instance, in the present television broadcasting system, picture information is transmitted at an interval of 30 frames per approximately 1 seconds (actually, 60 frames due to the interlace operation).

When an audio signal and a picture signal to be transmitted are digital signals, the above-described A/D converter 22 is not required, but also the D/A converter 24 is unnecessary in such an output display unit capable of directly driving the display unit 25 by the digital signal so as to display the output from the image memory section 23.

Figure 7:
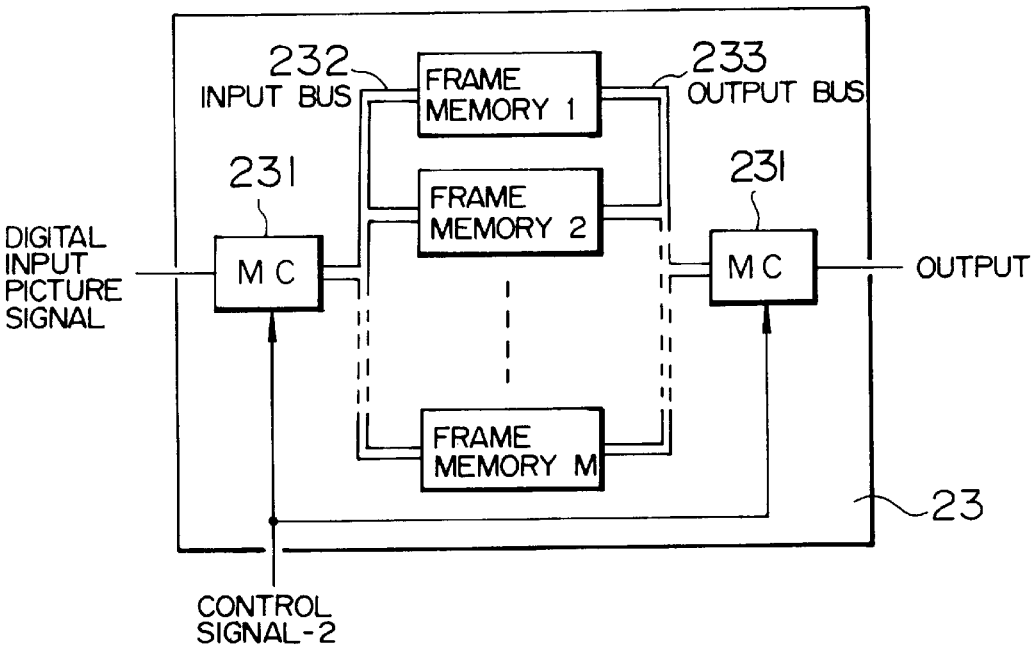
FIG. 7 is a schematic block diagram for showing an arrangement of an image memory device an embodiment used in the television receiver to which the digital acoustic signal processing apparatus of the present invention is utilized.

FIG. 7 is a schematic block diagram for showing an arrangement of an image memory section, as one preferred embodiment, of the television receiver which employs the digital acoustic signal processing apparatus of the present invention. In accordance with the apparatus of the present invention, a large quantity of semiconductor frame memories as shown in FIG. 7 is utilized as the image memory section 23. In the television receiver according to the present invention, in response to the control signal-2 supplied from the digital acoustic signal processing apparatus 1, a memory address changer 231 selects an input bus 232 and an output bus 233, and a plurality of semiconductor frame memories are circularly used. As a consequence, the picture frame information which is inputted during a time period when the acoustic signal has been expanded, is held and at the same time, the same frame picture is repeatedly outputted to the display 25 for display purposes in the digital acoustic signal processing apparatus. That is to say, while the acoustic signal containing the time period during which the time scale expansion processing is carried out in the digital acoustic signal processing apparatus 1, is being outputted to the speaker 26, the picture signal which should be originally outputted and displayed is repeatedly outputted to aid displayed on the display 25. It should be noted that if the memory capacity of this image memory section 23 is selected to be greater than the memory capacity required to store the image information having the frame number calculated in accordance with $F-\{(F-1)/N\}$, assuming now that a picture frame number of all picture information contained by a television program, the time scale of which is expanded so as to be monitored, is "F", and also a maximum expansion ratio when the time scale is expanded is "N", the picture information can be reproduced at the low speed without losing the picture information.

Figure 8:
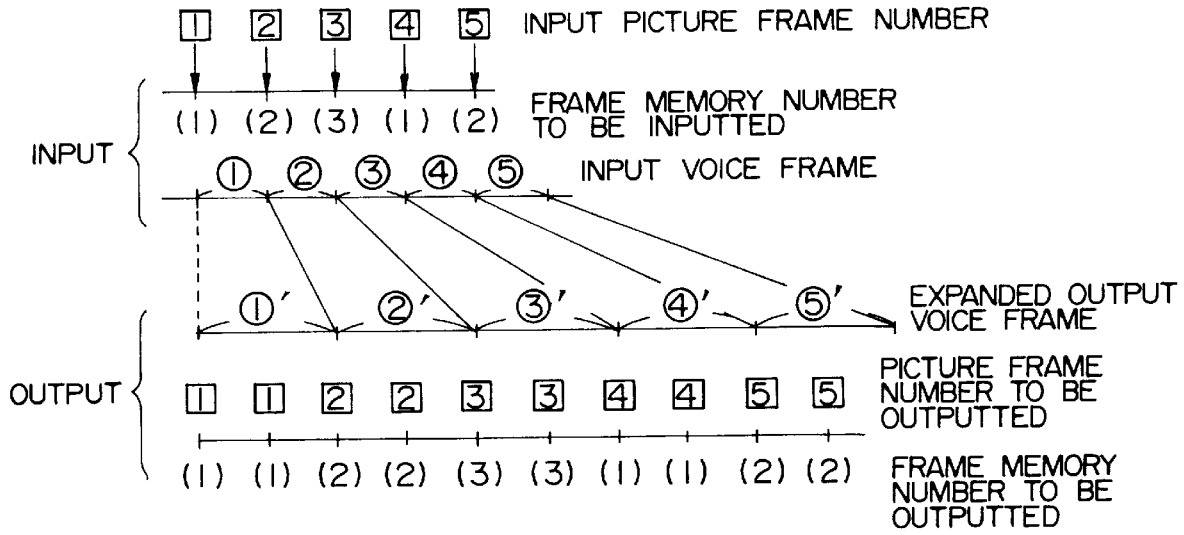
FIG. 8 is an explanatory diagram for showing a temporal relationship between an acoustic signal and an image signal in the television receiver to which the digital acoustic signal processing apparatus is utilized.

FIG. 8 is an explanatory diagram for showing a temporal relationship between an audio signal and a picture signal in the television receiver into which the digital acoustic signal processing apparatus of the present invention is employed. In FIG. 8, there is schematically shown a temporal relationship among input/output pictures and a voice frame in such a case that the picture frame number of all picture information, the time scale of which is expanded so as to be monitored, is selected to be 5, and the expansion ratio for expanding the time scale is selected to be 2. Since all of the picture frames are 5 and the expansion ratio is 2, the value calculated in the above-described formula becomes 3. If the memory capacity of the frame memory is selected to be greater than 3 frames of the picture information, the object can be achieved. Since the time scale has been time expanded and outputted, the same frame pictures are represented two times, so that the low speed reproduction is performed. The frame memory having three frames is circularly used.

On the other hand, although the semiconductor memory has been used as the image memory section 23 in the above-described preferred embodiment, it is apparent from the sound storage operation that either an optical disk apparatus, or a magnetic disk apparatus, which can be read/written, may be similarly utilized as the image information recording section.

Figure 9:
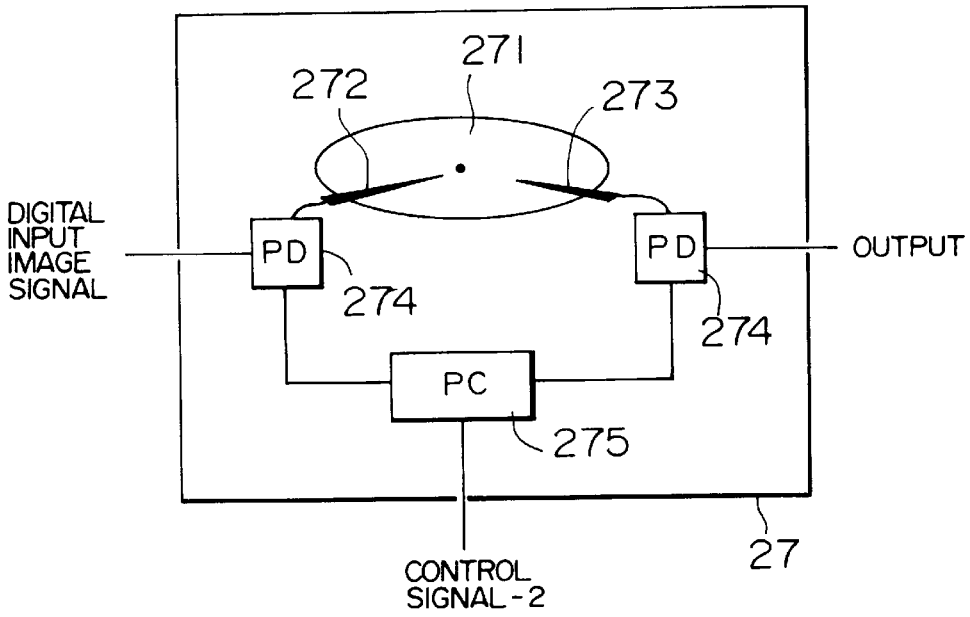
FIG. 9 is a schematic block diagram for representing an image memory device as another embodiment, used in the television receiver to which the digital acoustic signal processing apparatus of the present invention is utilized.

FIG. 9 is a schematic block diagram for showing an image memory section, as another preferred embodiment, of a television receiver into which the digital acoustic signal processing apparatus of the present invention has been employed. In FIG. 9, there is shown an arrangement of an image memory section 27 when these disk apparatuses are utilized. This apparatus comprises two independent heads, i.e., a writing head for writing information into either an optical disk or a magnetic disk 271, and a reading head for reading the information therefrom. Both of a writing operation of image information being transmitted at present, and also a reading operation of image information transmitted in the past are performed at the same time via the same disk in this apparatus. These two independent writing head 272 and reading head 273 are positioned by a positioning driver 274 under control of a positioning controller 275. Since the information of the image frames which have been recorded in the past are repeatedly read out by the reading head 273, the same image frames are repeatedly represented on the display, and a care is taken not to produce a time shift between the image output and the sound output.

Figure 10:
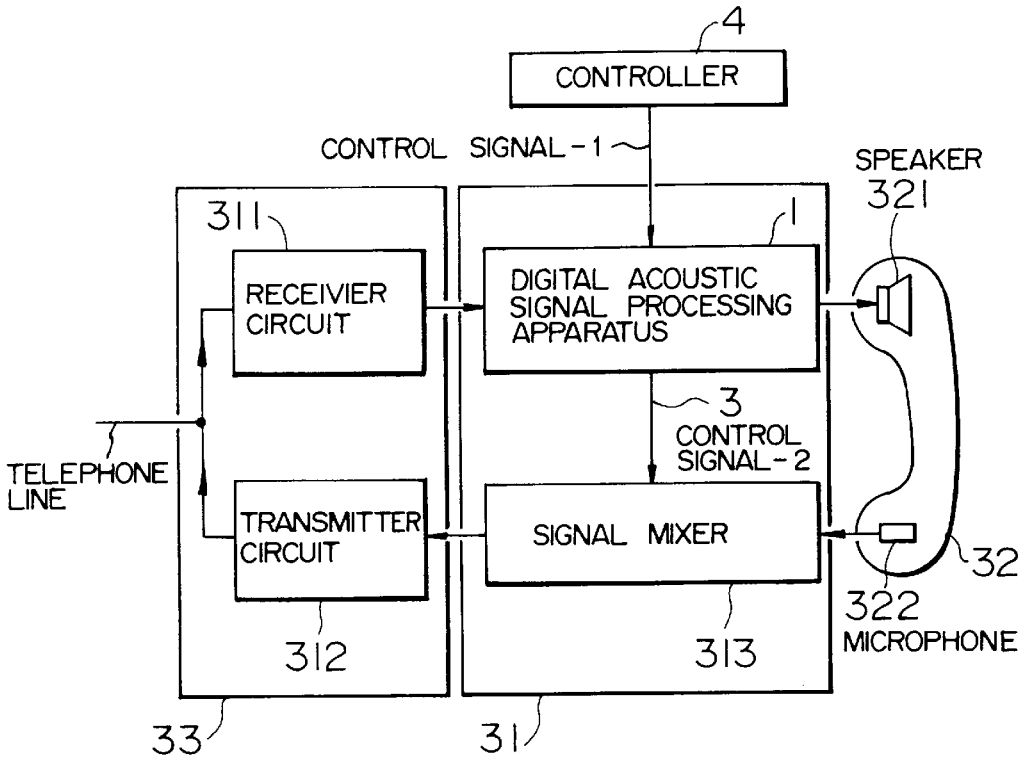
FIG. 10 is a schematic block diagram for indicating an arrangement of a telephone receiver as an embodiment, to which the digital acoustic signal processing apparatus of the present invention is utilized.

FIG. 10 is a schematic block diagram for showing an arrangement of a telephone receiver, as a preferred embodiment, into which the digital acoustic signal processing apparatus of the present invention is employed. As shown in FIG. 10, a hearing-function supporting device 31 constructed of the digital acoustic signal processing apparatus 1 according to the present invention and a signal mixer 313 (will be discussed later), is coupled between a receiver 32 of the telephone receiver and a receiver circuit 33. In case of a telephone receiver, an acoustic signal is sent via a telephone line, and then converted into an audible band signal by a receiver circuit 311. The digital acoustic signal processing apparatus 1 according to the present invention receives this audible-band-converted acoustic signal, executes the above-explained frequency feature enhancement and low speed voice reproduction in response to a control signal-1 which corresponds to starting/ending instructions set by a user via the controller 4, and then outputs the processed sound to a speaker 321. In particular to the frequency feature enhancement, the frequency characteristic under which a listener can easily listen to a sound even in a noisy surrounding environment, taking account of not only personal hearing characteristics, but also acoustic characteristics of a telephone receiver under use conditions.

On the other hand, when a listener performs the low speed voice reproducing process in case of a telephone receiver, the listener still hears the reproduced voice just after a speaker interrupts his talk. As a result, such an unnatural conversation is caused that the listener cannot immediately make his answer to the speaker just after the speaker interrupts his talk. To avoid such an unnatural conversation, such a signal mixer 313 is provided in the digital acoustic signal processing apparatus 1 of the present invention that a signal indicating that "a listener is hearing a reproduced voice" is supplied via a transmitter circuit 312 to a speaker while the listener is still hearing the reproduced voice after the speaker has interrupted his talk. A control signal-3 indicating that the listener is still hearing the reproduced sound, is supplied from the digital acoustic signal processing apparatus 1 to the signal mixer 313, and then this signal mixer 313 sends out this signal indicative of "under listening of reproduced voice" via the transmitter circuit 312 to the telephone line so as to transmit this condition to the speaker. As one example of the output signals from this signal mixer 313, a constant continuous signal is given to a speaker while the low speed voice reproduction by the listener is accomplished after the speaker has interrupted his talk and then no acoustic signal is inputted from a microphone 322. As a consequence, a two-way conversation may be smoothly achieved.

Figure 11:
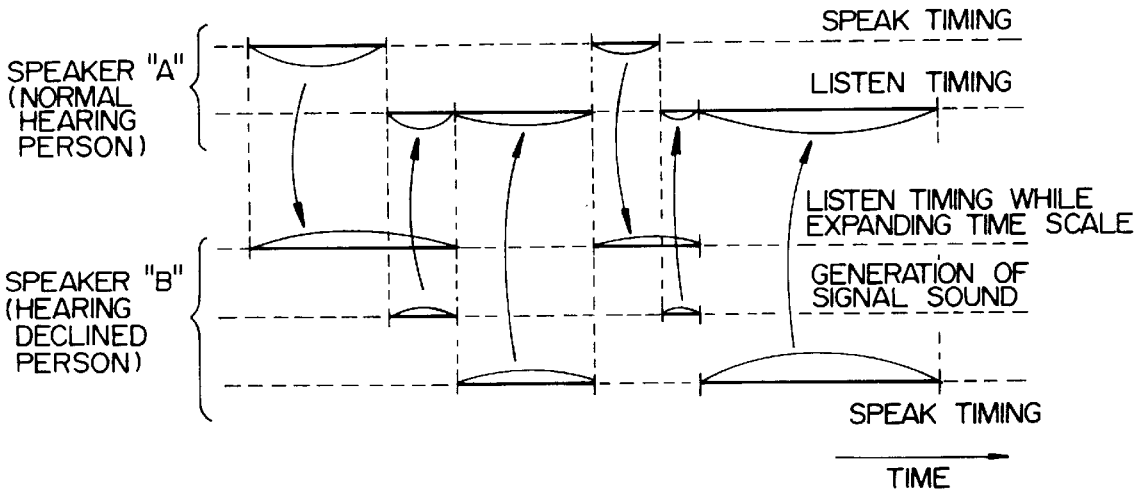
FIG. 11 is an explanatory diagram for representing a temporal relationship among speech timing, hearing timing and acoustic-sound producing timing while a normal hearing and an abnormal hearing make conversation with employment of a telephone receiver to which the digital acoustic signal processing apparatus of the present invention is utilized.

FIG. 11 is an explanatory diagram for showing a temporal relationship among listening/speaking timings of listener/speaker and signal sound generating timing when a conversation is made with employment of the digital acoustic signal processing apparatus in a telephone receiver. In FIG. 11, there is shown such a temporal relationship among the "speak/listen" timings and the signal sound generating timing under condition that a hearing difficulty person "B" listens to a voice of a normal hearing person "A", and uses the apparatus according to the present invention with utilizing a process to expand a temporal length by 1.5 times.

Also, it is apparent that a bi-directional conversation communication involving a voice signal and an image signal may be smoothly performed as in a television telephone receiver by utilizing the techniques as disclosed in the preferred embodiments with reference to FIGS. 6 to 9 and FIGS. 10 to 11.

Although the digital acoustic signal processing apparatus according to the present invention has been applied to the television receivers and the telephone receivers, this digital acoustic signal processing apparatus may be utilized into other apparatuses with a voice output, or both of a voice output and an image output, for instance, a radio receiver, a tape recorder, a video cassette recorder, a stereo receiver, a CD player, a local-area broadcasting equipment, a video conference system and the like. Accordingly, articulation of a voice outputted to a hearing difficulty person can be improved by utilizing these apparatuses.

In accordance with the present invention, since the voice whose frequency characteristic has been enhanced is reproduced at the low speed in order that personal hearing acuity as well as the apparatus is fitted to use environments thereof, hearing articulation with respect to a person whose frequency resolution and time resolution are simultaneously deteriorated, can be improved.

What is claimed is:

1. A digital voice processing apparatus, comprising:

process means which carries out a frequency processing for changing a frequency characteristic without changing a time scale thereof and a temporal length processing to expand the time scale of a voice without changing a pitch interval thereof with the voice digitized; and a control means which indicates a commencement and end for one of the frequency processing and the temporal length processing to be carried out by the process means, wherein the process means which carries out the temporal length processing such that a time-region harmonic structured expansion and contraction processing is applied to a voice portion having a periodical waveform and that a silent period of the voice is expanded.

2. A digital voice processing apparatus according to claim 1, wherein a parameter used for one of the frequency processing and the temporal length processing is adjusted in accordance with an aural characteristic of user.

3. A digital voice processing apparatus as claimed in claim 1, wherein said temporal length processing of temporal length includes interposing a silent period between voiced parts of an acoustic signal.

4. A digital voice processing apparatus as claimed in claim 1, wherein said digital voice processing apparatus is for processing an analog input acoustic signal corresponding to a received acoustic signal of a bi-directional communication signal having both a received acoustic signal and a transmit acoustic signal, said digital voice processing apparatus further comprising:

a telephone receiver including both a speaker for outputting an analog acoustic signal converted by a D/A converter and a microphone for picking up a narrator's voice;

a mixer for mixing an output of said microphone with a control signal when no narrator's voice is being inputted from said microphone, said control signal indicating that a listener is still hearing a time-expanded presentation of said narrator's voice by said digital voice processing apparatus; and a receiver circuit including a transmitter circuit which is coupled to said digital voice processing apparatus, wherein said receiver circuit receives said analog input acoustic signal from said bi-directional communication signal to convert a band of said analog input into an audible band.

5. A digital voice processing apparatus as claimed in claim 1, wherein said control means is adapted to indicate a stored digital acoustic signal relating to an inputted voice signal of a predetermined time interval prior to the indication of the user.

6. A digital voice processing apparatus, including: an A/D converter for digitizing a voice signal to be inputted; a memory for storing the digital voice signal output from the A/D converter; a processor for processing the digitized voice signal output from the A/D converter for converting the processed digital voice signal into an analog signal, wherein the processor processes the digital voice signal with use of a programming for processing the voice frequency characteristic and another programming for expanding a time scale of the voice signal, in response to an instruction from a controller, and the programming for expanding the time scale of the voice signal executes one of a time-region harmonic structured expansion and contraction processing for a voice portion having a periodical waveform and an expansion processing for a silent period of the voice signal, expanding the time scale of the voice signal.

7. A digital voice processing apparatus as claimed in claim 6, wherein said controller indicates a stored digital acoustic signal relating to an inputted voice signal of a predetermined time interval prior to selection of a reproduction mode by the user.

8. A digital voice processing method, comprising the steps of:

(a) indicating a digital voice signal stored in a memory in response to selecting one of a first mode and a second mode by user; and (b) processing a frequency characteristic and a time scale for the indicated digital voice signal, wherein in the step (a), the digital voice signal stored in the memory is indicated in time series at the first mode, the digital voice signal stored therein is indicated by going back in time in the second mode, and wherein in the step (b), the time scale processing is carried out by one of each of such that a time-region harmonic structured expansion and contraction processing is applied to a voice portion having a periodical waveform and that a silent period of the voice is expanded.

* * * * *